US006292976B1

(12) United States Patent
Kurcz et al.

(10) Patent No.: US 6,292,976 B1
(45) Date of Patent: Sep. 25, 2001

(54) DEVICE FOR PROVIDING SURFACE PREPARATION

(75) Inventors: Timothy J. Kurcz, Milford; Steven C. Moore, Grosse Pointe Farms, both of MI (US)

(73) Assignee: Loctite Corporation, Hartford, CT (US)

( * ) Notice: Subject to any disclaimer, the term of this patent is extended or adjusted under 35 U.S.C. 154(b) by 0 days.

(21) Appl. No.: 09/623,868

(22) PCT Filed: May 18, 1999

(86) PCT No.: PCT/US99/10897

§ 371 Date: Sep. 7, 2000

§ 102(e) Date: Sep. 7, 2000

(87) PCT Pub. No.: WO99/59739

PCT Pub. Date: Nov. 25, 1999

Related U.S. Application Data

(60) Provisional application No. 60/085,986, filed on Jun. 19, 1998.

(51) Int. Cl.[7] ..... B08B 1/00

(52) U.S. Cl. ..... 15/302; 15/97.1; 15/99; 15/308

(58) Field of Search ..... 15/302, 97.1, 308, 15/99

(56) References Cited

U.S. PATENT DOCUMENTS

| | | | | |
|---|---|---|---|---|
| 2,330,208 | * | 9/1943 | Fay | 15/99 X |
| 4,757,763 | | 7/1988 | MacPhee et al. . | |
| 4,982,469 | | 1/1991 | Nishiwaki . | |
| 5,491,871 | * | 2/1996 | Reber et al. | 15/308 |
| 5,519,914 | | 5/1996 | Egan . | |
| 5,542,143 | * | 8/1996 | Jem-Yuan | 15/99 X |
| 5,901,405 | * | 5/1999 | Tani | 15/309.2 X |
| 6,216,314 | * | 4/2001 | Dangerfield | 15/99 X |

FOREIGN PATENT DOCUMENTS

| | | |
|---|---|---|
| 0 391 340 A1 | 4/1990 | (EP) . |
| 2290463 A | 11/1992 | (GB) . |
| WO 98/30423 | 7/1998 | (WO) . |

* cited by examiner

*Primary Examiner*—Chris K. Moore
(74) *Attorney, Agent, or Firm*—Hoffman & Baron, LLP

(57) ABSTRACT

An apparatus cleans, primes and prepares a surface onto which a gasket, adhesive or other bonding agent is to be applied. The apparatus includes a robotic device capable of movement along multiple axes. An end effector is supported by the robotic device (18) for movement along the surface (35) to be cleaned. A felt supply assembly (12) delivers felt (14) under tension to the end effector (20). A cleaning fluid delivery system (34, 34*a*, 36*a*) applies cleaning fluid through the end effector directly to the felt for application to the surface to be cleaned. The end effector also includes 42 a squeegee-like elastomer wiping device (51) which scrapes the surface by removing gross contaminants from the surface. An air knife (52) is provided which force-flashes fluid residue. The movement of the end effector is controlled by a preprogrammed numeric controller (22) which also provides for precise application of fluid to the felt, advancement of the felt on-the-fly, and monitoring pressure of the end effector against the surface to be cleaned.

19 Claims, 10 Drawing Sheets

DEVICE FOR PROVIDING SURFACE PREPARATION

This application is a 371 of PCT/US99/10897 filed May 18, 1999, which claims benefit of Prov. No. 60/085,986.

FIELD OF THE INVENTION

The present invention relates generally to a device used to clean, prime or otherwise prepare a surface onto which a gasket, adhesive or other bonding agent is to be applied. More particularly, the present invention relates to a robotic arm end effector which is used to prepare such a surface having complex geometry.

BACKGROUND OF THE INVENTION

The use of gaskets, adhesives and other types of bonding agents to provide a sealed interface between two mating components, as well as to adhere one component to another component is well known. In the industry such materials (referred to hereinafter collectively as gaskets) are widely used for a variety of purposes. Common uses for gaskets in the automotive industry include effecting a seal between components such as the transmission case and the transmission pan or an engine block and oil pan, rocker cover or similar covers. Other purposes may include the use of gasket-type adhesives to secure automobile glass.

In certain of these applications the gasket is applied to one of the components by forming the gasket directly on the component prior to assembly. This technique is known as formed-in- place (FIP) gasketing. Prior to forming a gasket in place, it is desirable to clean, prime or otherwise prepare the flange surface onto which the gasket is applied where the surface contains contaminants or where it is necessary to increase surface reactivity. This is particularly necessary in manufacturing assembly situations where the part may be coated or exposed to oils, greases, transmission fluids and the like which are used as part of the assembly operation. In one example, the art has seen the use of various robotically controlled devices to clean or prime automotive windshield glass. These robotic machines apply a cleaning fluid or along a path traced by the robotic machine over the component surface. The robotic machine also provides a wiping device, such as a felt strip, which follows the applied fluid to wipe the fluid along the traced path. These robotically controlled cleaning devices serve adequately where the surface is of relatively simple geometry such as that found with automobile glass. With complex parts, such as for example, the flange on a transmission, existing robotically controlled cleaning devices cannot take advantage of the full range of motion of the robot due to their size and configuration. Many of these devices rely on "drip and drag" technology where the solvent is applied at a location spaced 2–2½ inches from the felt. These existing devices can not adequately clean complex surfaces where the device is required to make many turns and thus cannot accurately traverse the path onto which the gasket must be applied. This may result in incomplete cleaning of the surface and resultant poor adhesion of the subsequently applied gasket on the surface.

Furthermore, in certain assembly situations, the cleaning device must remove a significant amount of surface contaminants. For example, in the application of gasketing in an automatic transmission situation, the cleaning device must remove residual automatic transmission fluid which drains out onto the flange surface in test operations. As may be appreciated, the wiping felt thus absorbs the automatic transmission fluid. In order to effectively clean the entire surface, it is necessary to present clean felt to the surface to be cleaned. The cleaning device must therefore permit continuous feeding of clean felt to the head of the device to assure complete cleaning of the surface being traversed.

Existing heads have limited felt storage capacity. Furthermore, even where a supply of additional felt is provided, the existing heads do not accurately or continually advance the felt so as to present a continuous clean felt portion in contact with the surface to be cleaned.

It is therefore desirable to provide a device which will effectively clean a flange or mating surface in a continuous automated fashion where the surface to be cleaned has complex geometry and may include varying degrees of localized contaminants.

SUMMARY OF THE INVENTION

The present invention provides an improved device for cleaning, priming or preparing a flange or mating surface. The device provides for a continuous advancement and escapement of felt material under tension from a remote supply to a remote collection container.

An improved end effector of the present invention deposits a cleaning fluid directly on the felt so that the fluid-wetted felt wipes fluid on the flange surface. In advance of the fluid-wetted felt contacting the flange surface, a squeegee pre-cleans the surface. After application of the cleaning fluid-wetted felt to the surface, an air knife force-flashes off the cleaning fluid.

The end effector is biased so as to provide constant pressure against the flange surface to assure continuous uniform wiping of the fluid-wetted felt across the flange surface. Movement of the end effector by the robotic arm as well as advancement of the felt, application of cleaning fluid, and pressure sensing is controlled and monitored by a preprogrammed numeric controller.

DETAILED DESCRIPTION OF THE PREFERRED EMBODIMENT

The present invention provides a robotically controlled device for cleaning, priming or otherwise preparing a flange or mating surface (hereinafter referred to as a flange surface). As will be described in further detail hereinbelow, the device of the present invention allows for the cleaning of a surface having complex geometry such as that found in automotive applications, particularly in gasketing situations associated with engine blocks and automatic transmissions. In certain applications, it is necessary to allow the cleaning device to traverse a complex path which may include undulating surfaces, sharp turns, upstanding wall surfaces which require the device to operate in positions including a vertically up, vertically down or horizontal orientation and the like. The cleaning device of the present invention deposits a cleaning fluid directly onto a continuously advanced supply of felt which wipes the fluid on the surface to be cleaned. Prior to wiping the fluid on the surface, the device wipes a squeegee-like knife along the surface to remove residually deposited oils, fluids or other contaminants. Immediately after applying the felt-applied fluid, an air knife force-flashes off the fluid.

The device of the present invention allows continuous feeding of felt under tension from a remote supply and the continuous escapement of felt under tension to a remote collection container, thus enabling the device to continually operate in an automated assembly environment. Furthermore, the device includes a novel end effector which is relatively small and light weight. The construction and operation of the end effector allows the end effector to take full advantage of the six axes of motion which is provided by the robotic device to which it is attached.

Figure 1:
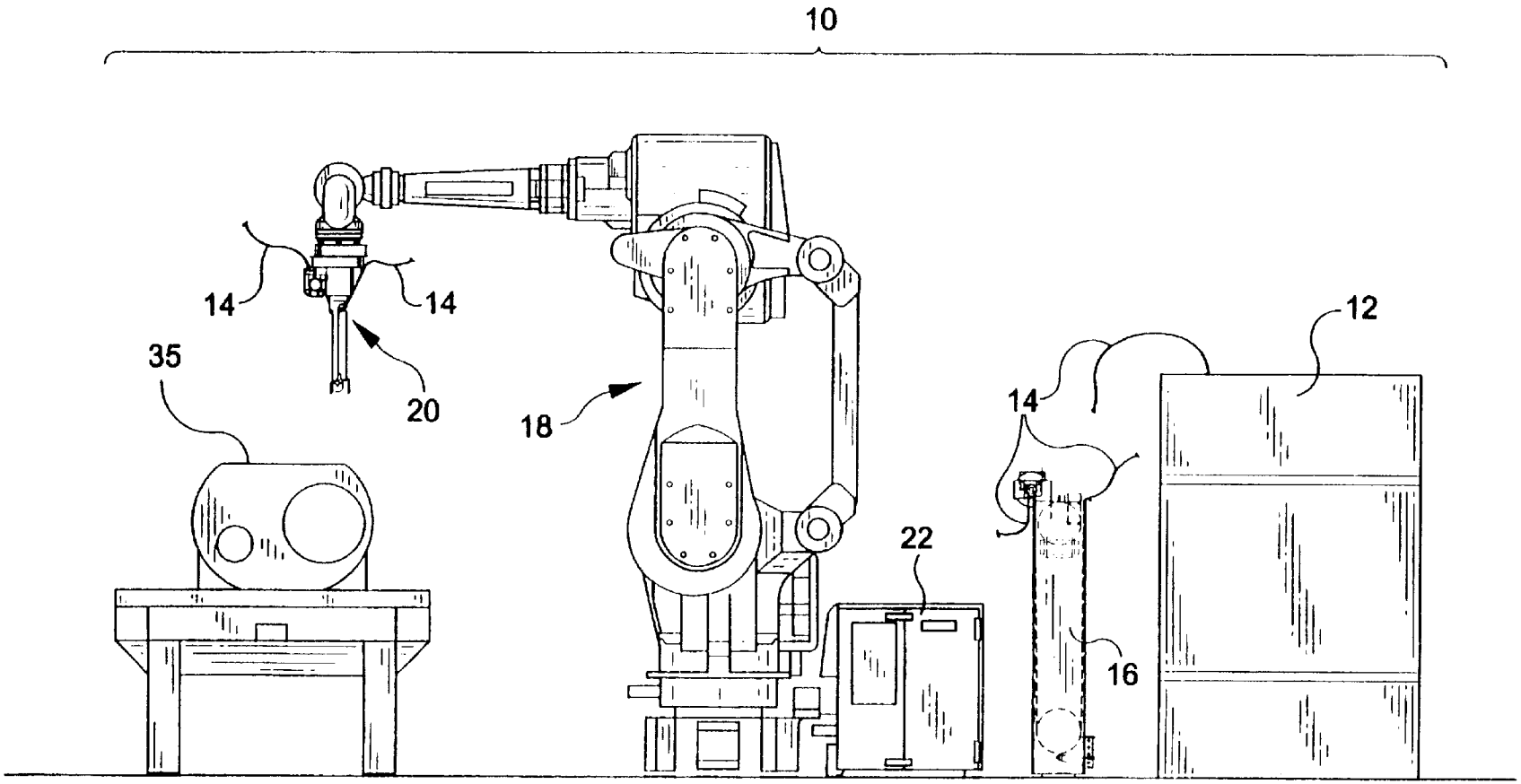
FIG. 1 is a schematic representation of the cleaning device of the present invention.

Referring now to FIG. 1, a schematic representation of the overall apparatus employing the device of the present invention is shown. Apparatus 10 includes a felt supply 12 for supplying a ribbon of felt 14 therefrom. Felt 14 is an elongate ribbon of absorbent felt-like cloth having a width of approximately ¾" and a thickness of approximately 3/32". Various styles, sizes and types of felt maybe employed in accordance with the present invention. The felt 14 is a fabric material formed into a ribbon-like structure and is commonly used for wiping a cleaning fluid to a surface. A large quantity of felt is housed within felt supply 12 which may be a spool or other container which permits the continuous feeding of felt 14 therefrom. Felt 14 is fed from supply 12 to a tension device 16. As will be described in further detail hereinbelow, the tension device maintains the ribbon of felt 14 under tension throughout the movement of felt during the cleaning operation.

A robotic device 18 is provided which moves an end effector 20 through six axes of motion under the control of a numeric controller 22. The robotic device 18 is a conventional six axis modular construction electric servo-driven robot, the movement of which is directed by preprogrammed numeric controller 22. Examples of commercially available robotic devices which may be used in combination with the present invention include a 3-axis adept gantry style robot as well as 6-axis robotic devices such as those supplied by Fanuc Robotics under the trade designation M-710i/iW and A.B.B. Robotics Products under the trade designation IRB 4400. While, the present invention is not limited to use with any particular robotic device, the robotic device must be capable of providing at least four, preferably six, geometrically dependent axes of motion so that the end effector can traverse the complex geometric path dictated by the motion program supplied to the numeric controller. Such capabilities allow the end effector to provide complete cleaning of a gasket-bearing surface having complex geometry such as that found in automotive applications including flanges in engine block, automatic transmission, and axle applications.

As will be described in further detail hereinbelow, the end effector 20 of the present invention is of construction which takes full advantage of the six axes of motion provided by the robotic device. It may be appreciated that, depending upon the application, it may necessary for the end effector to have full range of motion with respect to both linear and rotational movement. In typical operation a component which is to be cleaned, such as an engine or transmission, will be transported to a position above, below, or adjacent to the robotically controlled end effector. The end effector will be lowered to contact a flange surface 35 that requires cleaning. The robotic device will move the end effector along the flange surface to effect cleaning of the surface. The robotic device will then remove the end effector from the component to a stand-by position where, in a continuous operation, another component may be moved to the device for sequential cleaning.

In addition to providing preprogrammed movement of the end effector by way of the robotic device, the numeric controller 22 also provides direction for controlled surface pressure of the end effector against the flange surface. Such preprogrammed control surface pressure assures repeatable engineered contact between the felt which is cleaning the surface and the surface itself to assure complete cleaning of the flange path. Furthermore, as will be described in further detail hereinbelow, the numeric controller 22 may also be used to advance the felt through the end effector to provide a consistently clean felt surface portion.

Figure 2:
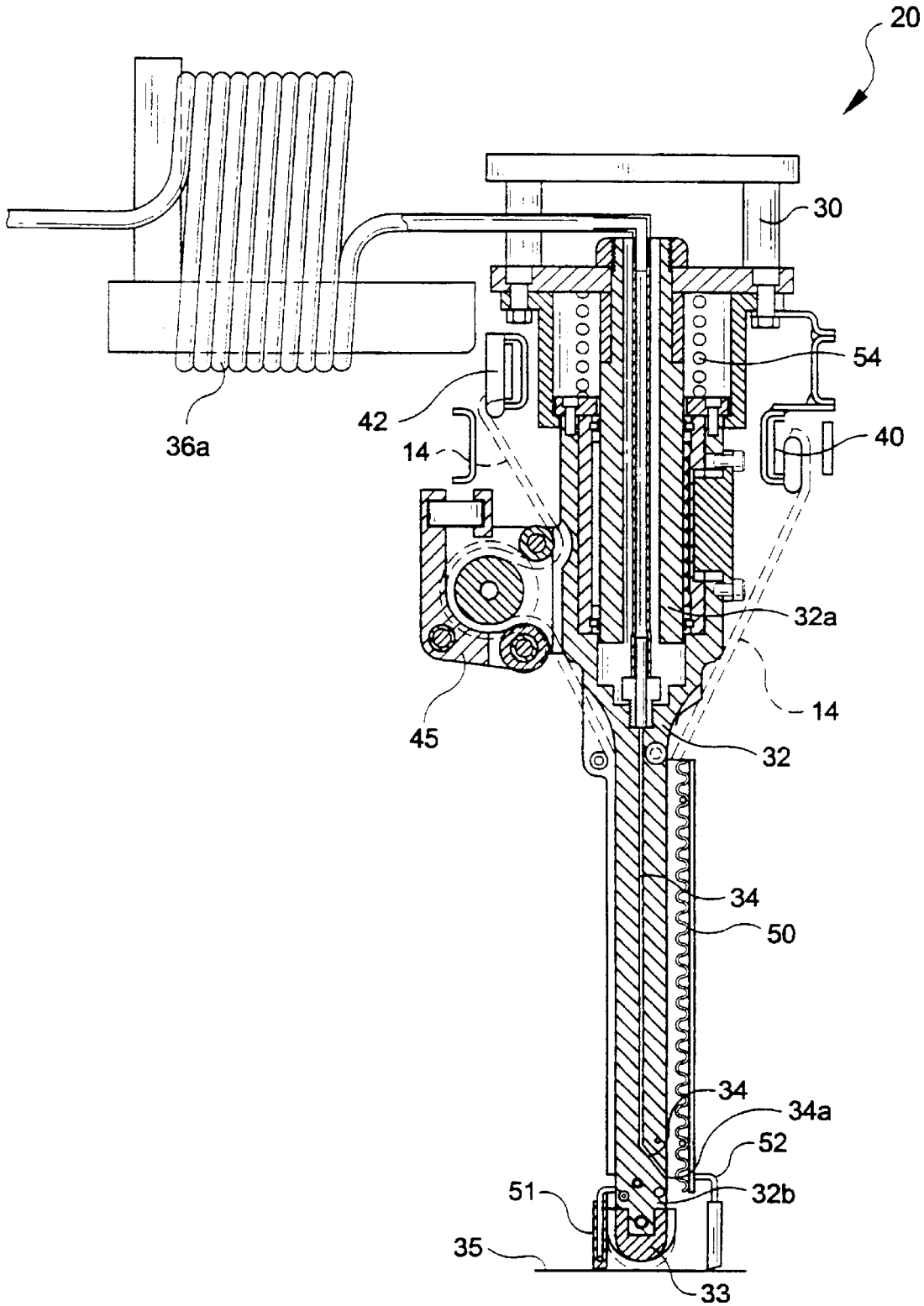
FIGS. 2 and 2A show in partial section details of an end effector used in combination with the device of FIG. 1.
Figure 2A:
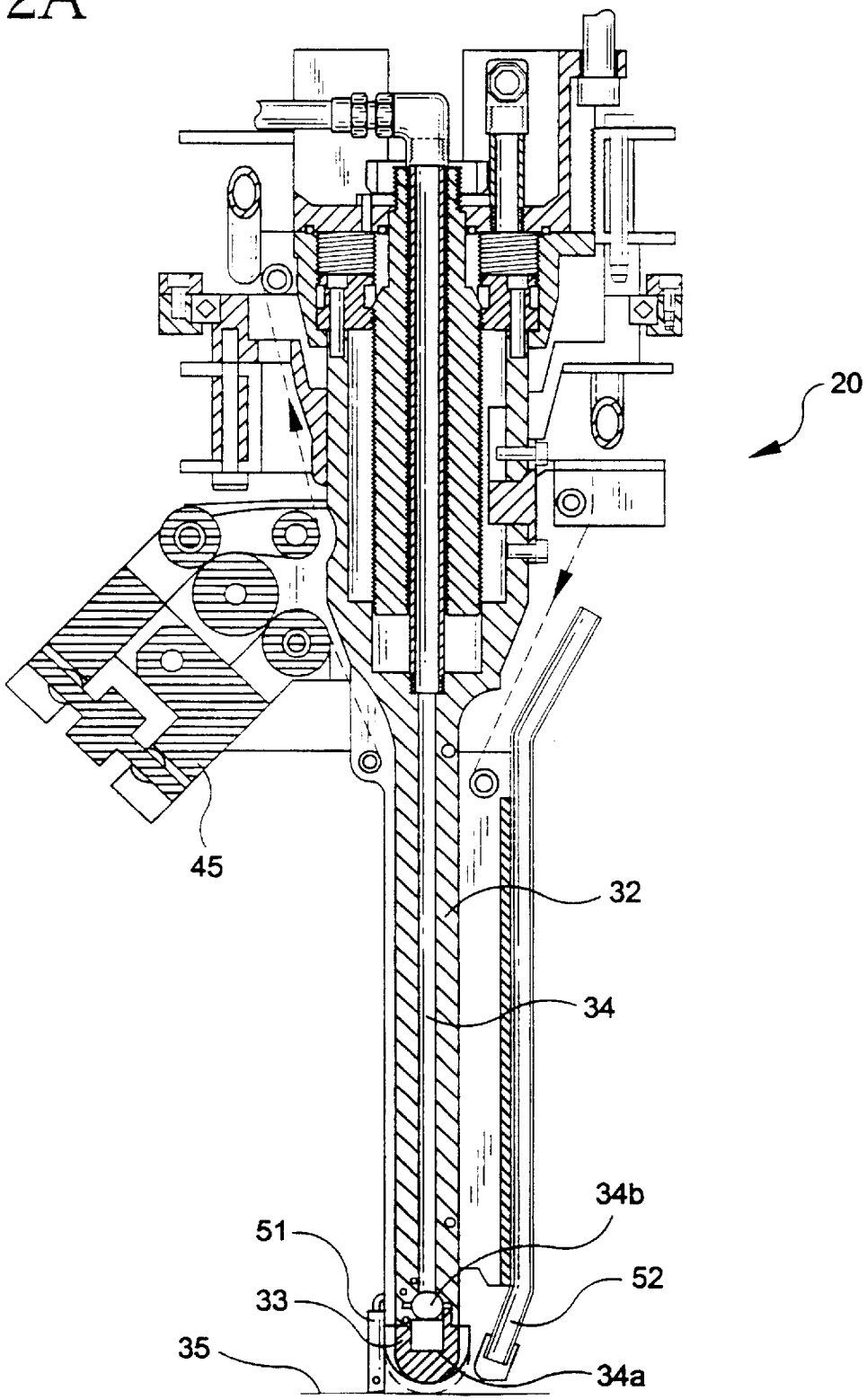
Figure 3:
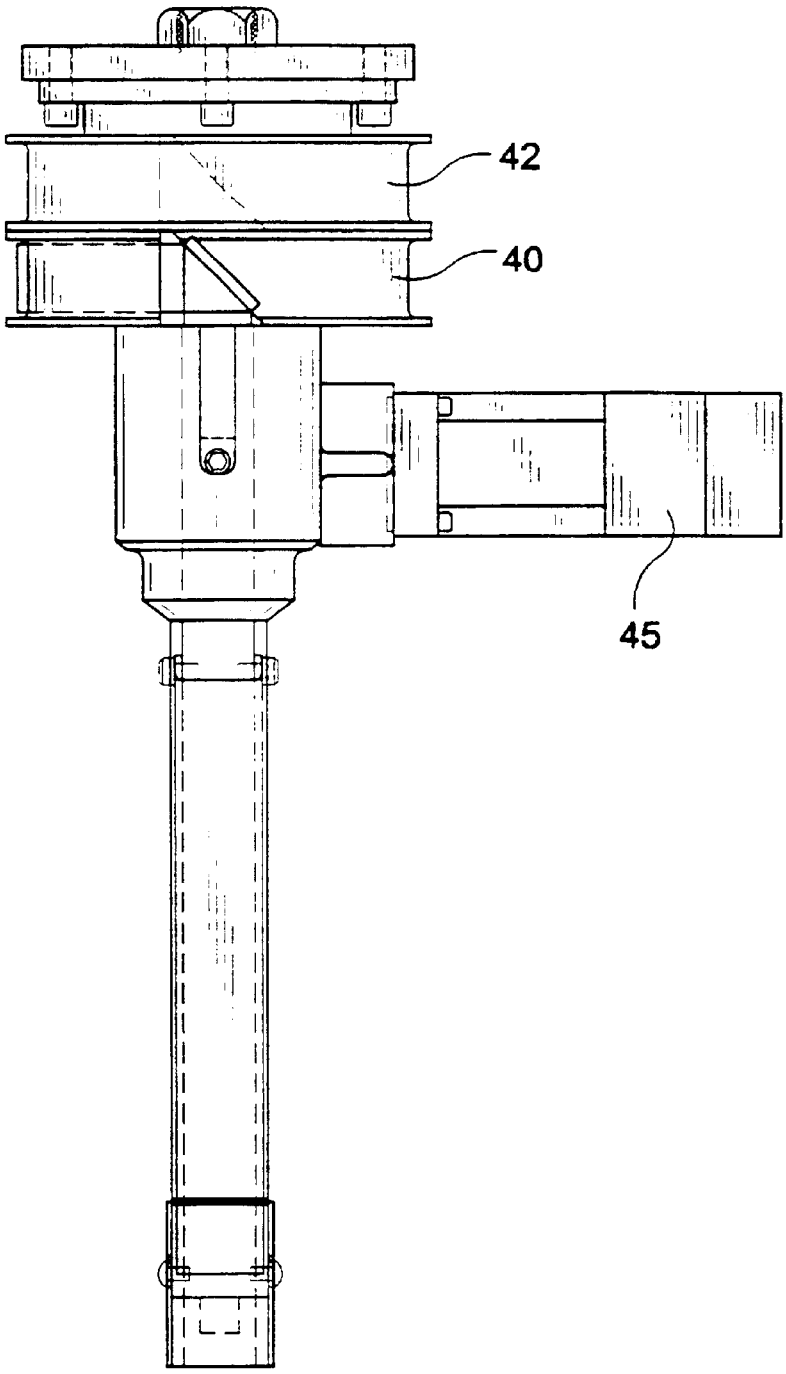
FIGS. 3 and 4 show respectively front and side views of the end effectors of FIG. 2.

Referring additionally to FIGS. 2, 2A, 3 and 4, details of end effector 20 of the present invention is shown. End effector 20 is an elongate member which is mounted by a mounting surface 30 to the wrist portion of the robotic device 18 shown in FIG. 1. End effector 20 has an elongate central member 32 having an upper mounting end 32*a* and a lower application end 32*b* terminating in a rounded application tip 33. Central member 32 includes a centrally located fluid channel 34 which is fed by a fluid conduit 36 which supplies a suitable cleaning fluid from a remote location (not shown). In the present example, the cleaning fluid may include a mixture of water and isopropyl alcohol and more specifically may be of the type sold by Loctite Corporation under the trade designation CLEANER 7070. However, the present invention is not limited to any particular cleaning fluid or solvent. Any suitable fluid may be employed in combination with the present invention. Fluid channel 34 maybe formed to have a dispense opening 34*a* adjacent lower end 32*b* through central member 32. More preferably as shown in FIG. 2A, the dispense opening 34*a* may extend through application tip 33. In the embodiment of FIG. 2A, dispense opening 34*a* is located proximate of the distal end of the rounded application tip 33 so that fluid is dispensed through the side of application tip 33. Also as shown in FIG. 2A the dispensing of fluid from opening 34*a* maybe further controlled by employing a ball check 34*b* within channel 34. The ball check 34*b* helps maintain fluid in channel 34 as well as helps modulate the dispensing of fluid through opening 34*a*.

The end effector 20 accommodates a continuously movable length of felt 14 supplied under tension from felt supply 12 through tension device 16. As specifically shown in FIGS. 3 and 4, the felt 14 is supplied to a pair of non-overlapping 360-degree rotating drums 40 which function as transition devices to positionally orient the felt so that it is properly positioned with respect to rounded application tip 33. An adjacent exit drum 42 is provided so as to transition used felt after it has progressed about rounded application tip 33. Movement of felt 14 is provided by a drive mechanism 45 including a servo motor and gear reduction which extends laterally from the central member 32 of end effector 20. FIGS. 2 and 2A show different constructions of drive mechanism 45. The drive mechanism 45 of FIG. 2A provides for more precision control of felt advancement preventing over tensioning or under tensioning of the felt. Drive mechanism 45 pulls the ribbon of felt 14 under tension from its entry position with respect to entry drum 40 along central member 32 and around rounded application tip 33. As the end effector is continuously moved along a path on flange surface 35, the drive mechanism 45, driven by instructions received from numeric controller 22, provides for the advancement of felt 14 so as to provide a continuously cleaned felt portion to the flange surface. The drive mechanism 45 may further include other structural components such as wheels, gears and the like which effect constant tension and advancement of the felt.

Figure 5:
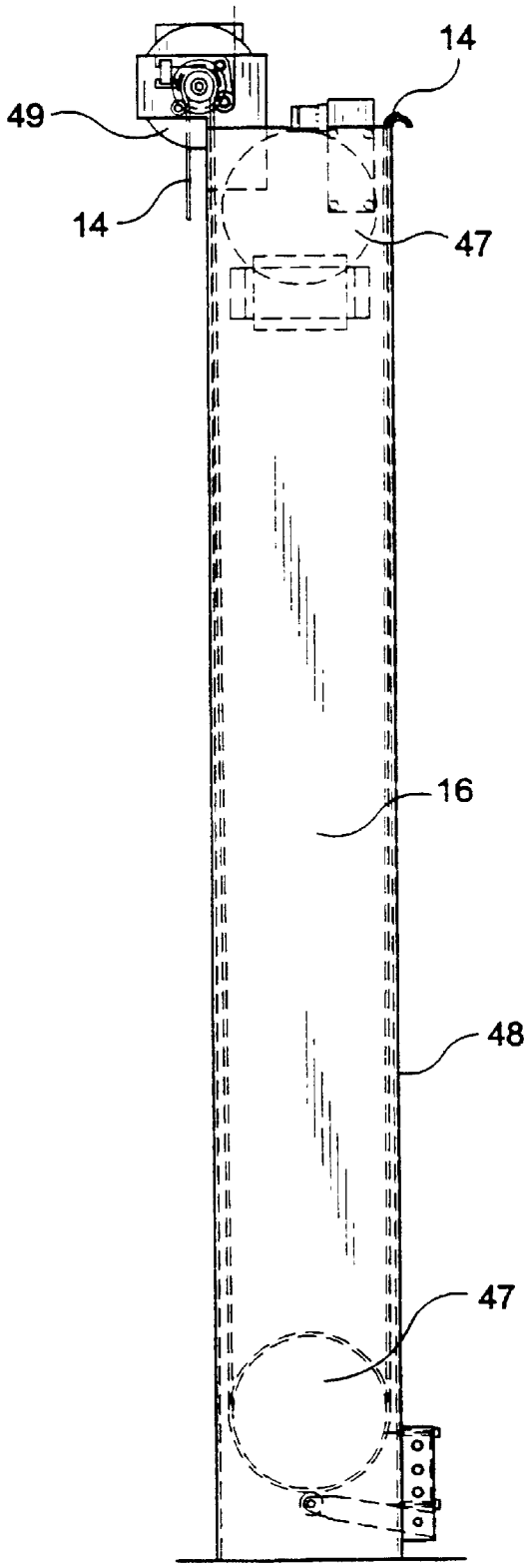
FIG. 5 shows generally the tension device shown in FIG. 1.
Figure 5A:
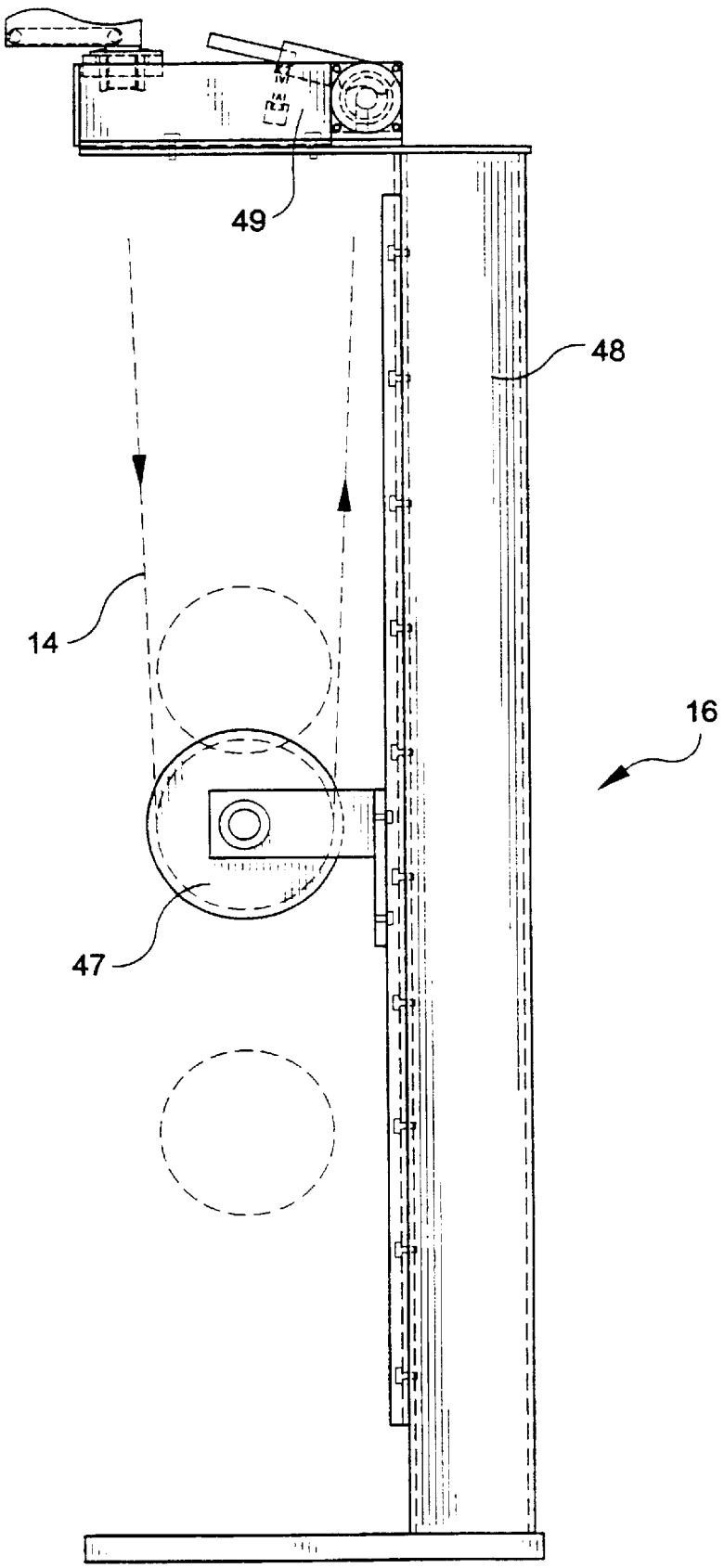
FIGS. 5A and 5B show side and front plan views respectively a tension device of the present invention.
Figure 5B:
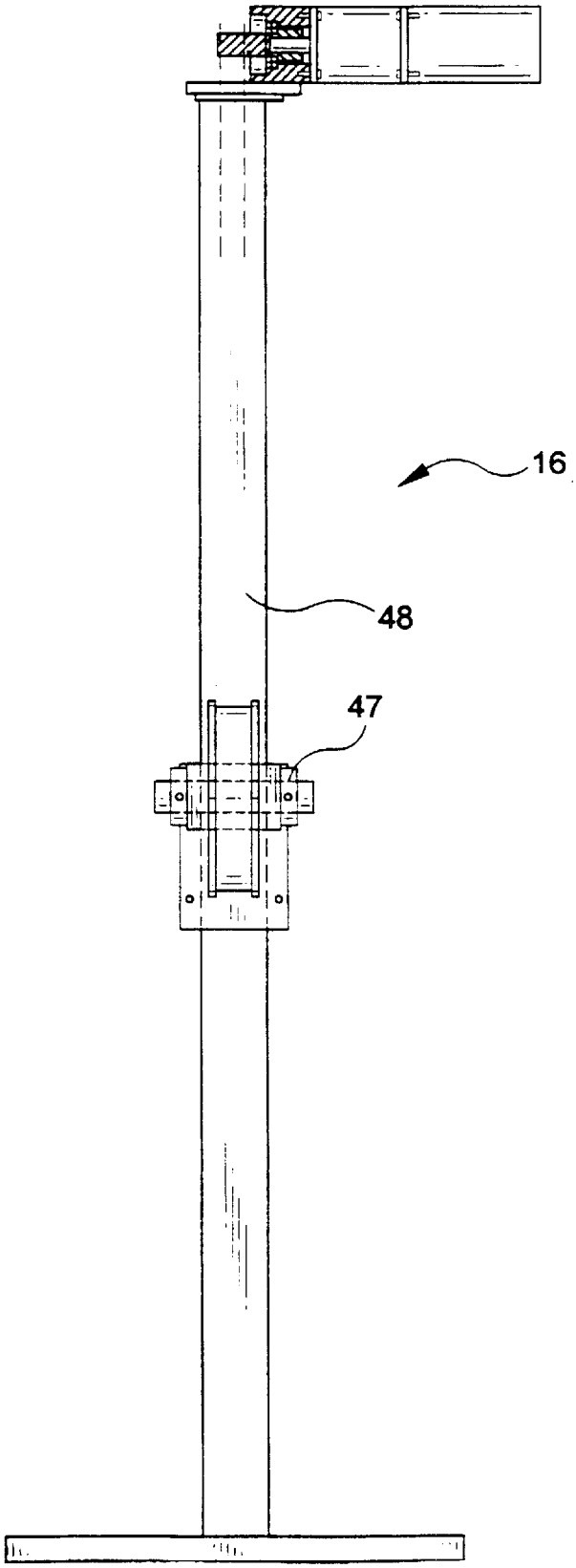

Referring additionally to FIGS. 5, 5A and 5B tension device 16 is shown. Tension device 16 accommodates the entry of felt from felt supply 12 at an upper end thereof. The ribbon of felt is advanced so as to be wrapped around a dancer wheel 47 which is vertically movable on a friction-free slide on stanchion 48 of tension device 16. As shown in FIG. 5 the dancer wheel 47 may be optionally enclosed by a housing which protects movement of the dancer wheel 47. After wrapping about dancer wheel 47, the ribbon of felt travels through a controlled advancement device 49 which maintains sufficient felt length within tension device 16 as the felt is advanced by drive mechanism 45 through end effector 20. The tension device 16 including dancer bar 47 and advancement device 49 assures controlled felt tension so as to permit the advance of felt by drive mechanism 45. As will be described below, a further similar dancer wheel device (not shown) is used to retract contaminated felt under controlled tension after movement across end effector 20.

Referring again to FIGS. 2, 2A and 3 once the felt is fed to entry drum 40, it is properly positioned and aligned for movement about central member 32 of end effector 20. As shown in FIG. 2, the end effector may optionally include a elongate sinusoidal spring 50 so as to maintain the felt against the body of central member 32. The application of fluid to felt 14 may also be controlled by numeric controller 22 (FIG. 1) so that a preprogrammed amount of fluid may be applied to the flange surface. The fluid-wetted felt passes beneath rounded application tip 33 where it wipes the flange surface 35 as the end effector moves along a predetermined path defining the flange surface.

Figure 4:
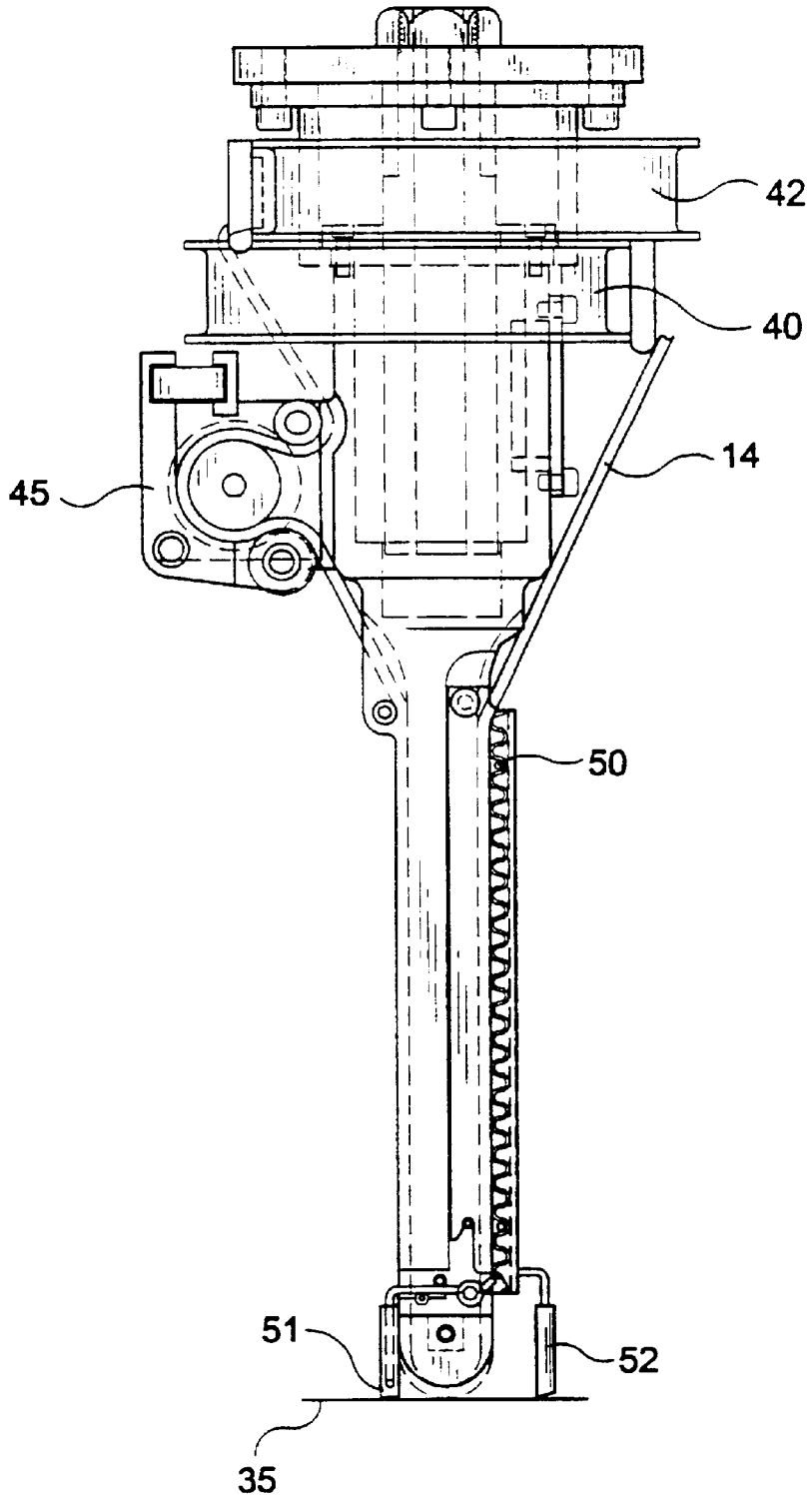

With specific reference to FIGS. 2, 2A and 4, the end effector 20 additionally provides a squeegee 51 mounted adjacent rounded application tip 33. Squeegee 51 may include an elastomeric member which is mounted on the leading side of movement of end effector 20 so that prior to the fluid-wetted felt applying fluid to the flange surface, the squeegee 51 wipes along the flange surface 35 removing a certain amount of debris, contaminant, oils and grease which may be on the flange surface. Thereafter the fluid-wetted felt wipes the fluid onto the flange surface further cleaning and priming the flange surface.

On the trailing side of end effector 20 adjacent the rounded application tip 33, an air knife 52 is provided. Shown in more detail in FIG. 2A, air knife 52 directs a directional flow of air or other gas to the now cleaned flange surface to force-flash off any residual fluid applied by the fluid-wetted felt 14. The air knife may be attached to the end effector with a quick disconnect coupling so as to facilitate replacement of the air knife.

As it wipes the fluid onto the flange surface, the felt picks up residue grease and oils thereon. The residue-bearing felt is now pulled upwardly along the body of central member 32 by drive mechanism 45. The used residue-bearing felt 14 is then transitioned at upper exit drum 42 for subsequent disposal by use of a take-up tension device (not shown). A remote collection hopper or container (also not shown) may be used to accumulate the used felt. The take-up tension device is substantially similar to tension device 16, including a stanchion or housing and a dancer wheel. The take-up device maintains felt tension on the escapement side of end effector 20 disposing contaminated felt within the remote collection container. A conventional photo-electric eye or proximity sensor may be employed with the take-up tension device to signal stoppage of the feeding or escapement when appropriate. Thus tension of the felt is maintained continually across end effector 20 as the felt is moved across application tip 33.

In order to assure accurate wiping of fluid by the felt onto the flange surface, the central member 32 is movably supported to the mounting portion 30. Surface pressure may be controlled by conventional bias spring 54. The spring allows movement of the central member with respect to mounting portion 30 so that engineered pressure may be placed against the flange surface 35 during cleaning. Movement of the central member with respect to mounting portion 30 may be monitored by numeric controller 22 so as to provide an accurate indication that proper contact is maintained between the felt 14 about application tip 33 and the flange surface. This feature assures that the entire flange surface is repeatably cleaned while providing quality feedback for fault-free production.

The end effector 20 of the present invention thus provides certain features not heretofore found in available devices. These features include the ability to centrally feed fluid from a remote supply directly onto the felt just prior to the advancing felt coming in contact with the flange surface. The end effector further provides for the controlled continuous advancement of the felt as the felt is traversing its path along the flange surface so that a perpetually clean portion of the felt is exposed to the flange surface. The rate of advancement of the felt, the surface pressure, and the amount of fluid disposed on the felt may be controlled by numeric controller 22 so as to provide fully programmable surface preparation characteristics. Furthermore, as the movement of the felt is effected under tension provided by the coordinated use of the drive mechanism 45, tension device 16 and the escapement tension device, accurate wiping of the fluid-wetted felt on the flange surface can be achieved.

The specific configuration of rounded application tip 33 in its position with respect to end effector 20 allows the end effector to take full advantage of the range of motion provided by robotic device 18. Thus, the end effector 20 provides engineered cleaning or preparation of the flange surface along a complex geometry such as may be presented in automotive applications. Since the fluid is deposited directly through the felt onto the flange surface, instead of dripped or sprayed by an offset dispenser, the end effector of the present invention permits utilization of the full range of motion of the robotic device. As the flange surface is wiped by fluid-soaked felt, the end effector may be applied to the flange surface in any attitude including vertically up, vertically down or horizontal. This allows cleaning of the complex flange surfaces found in certain applications. Further, enhanced cleaning of the flange surface is achieved by applying a leading in advance of fluid-wetted felt to preclean the surface. Additionally, a trailing air knife dries the clean surface evaporating fluid.

Figure 6:
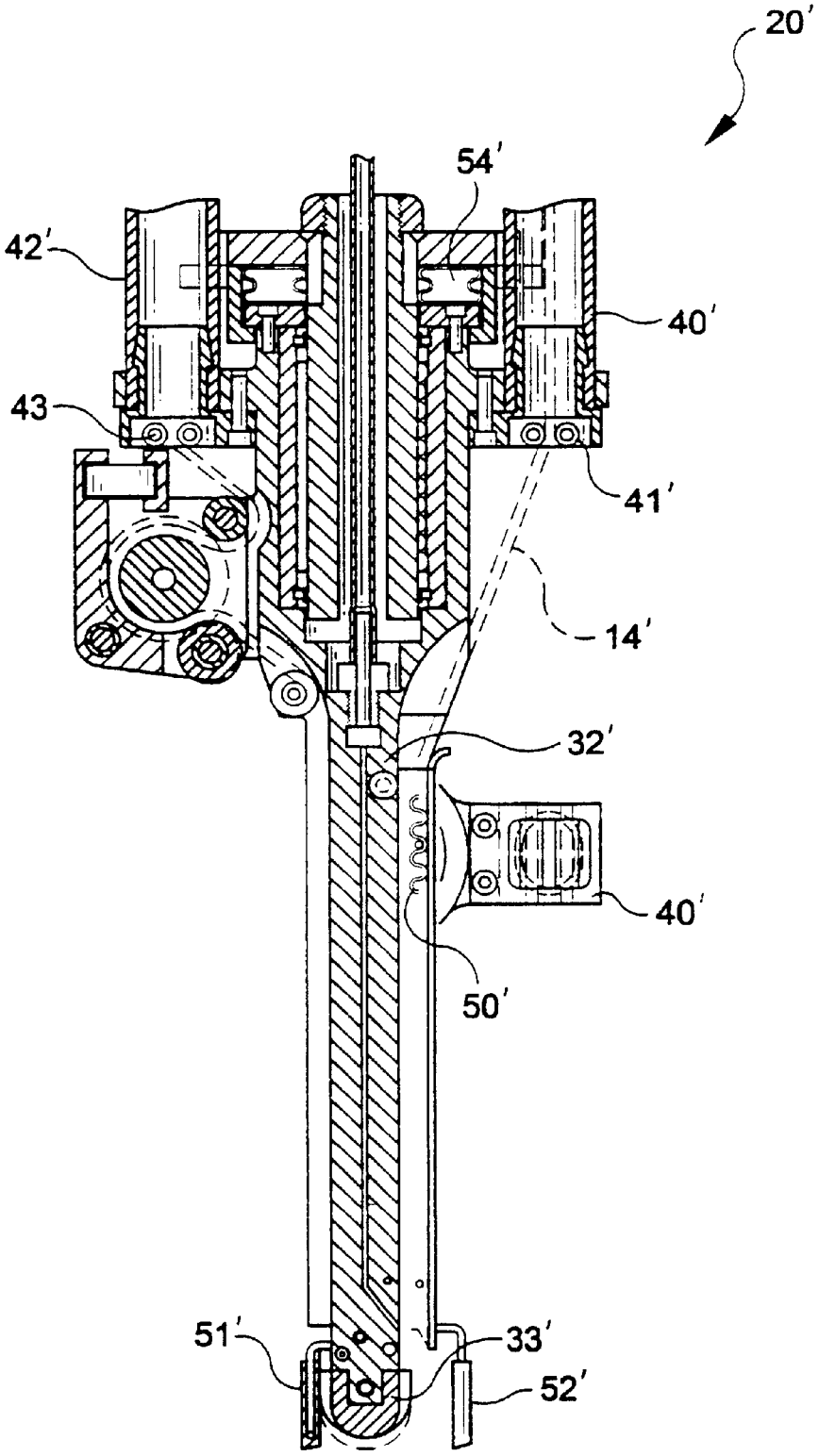
FIGS. 6 and 7 show a further embodiment of the end effector used in combination with the robotic device of FIG. 1.
Figure 7:
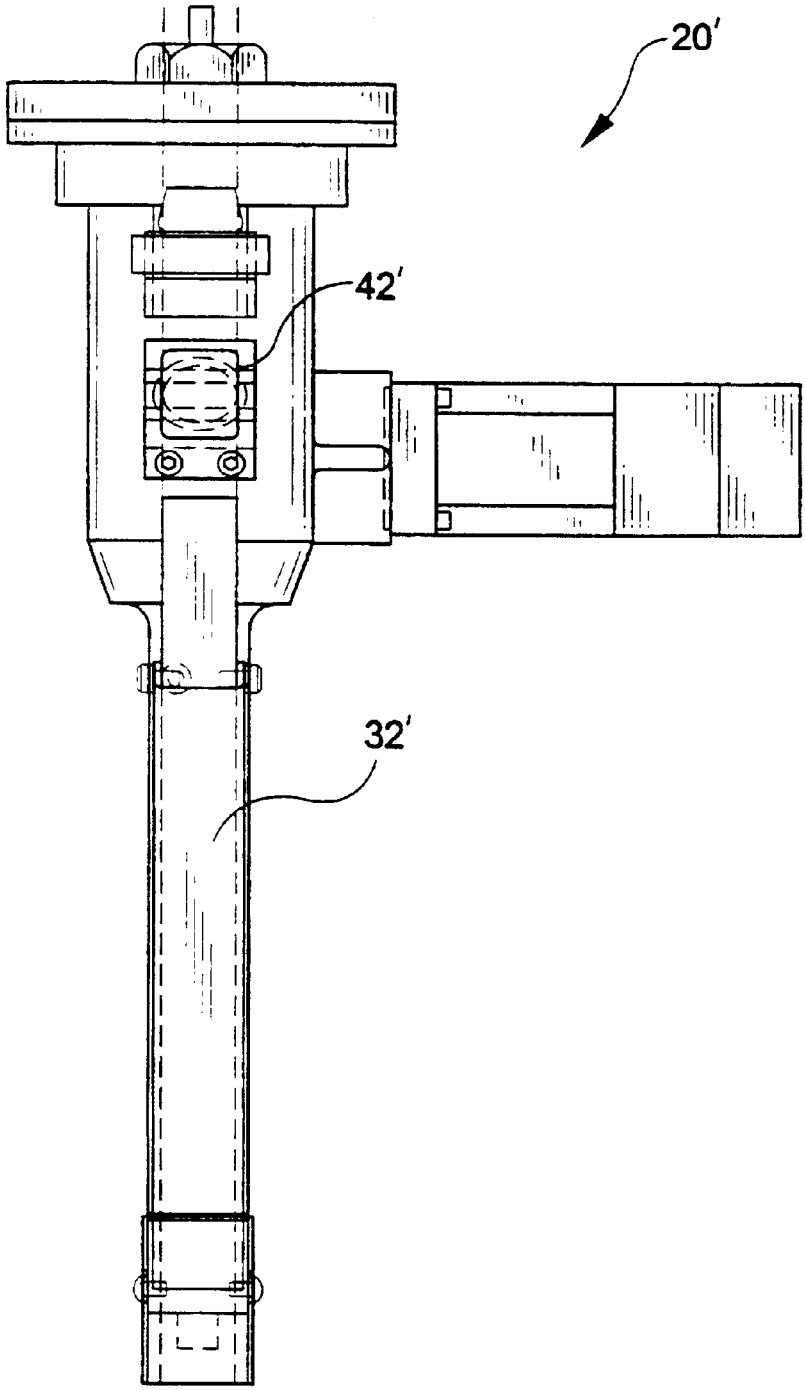

The above features and benefits are also found in a second embodiment of the present invention shown in FIGS. 6 and 7. End effector 20' is substantially similar to end effector 20 described above. Similar reference numerals are used to denote similar components. In the embodiment shown in FIGS. 6 and 7, the central member 32' is movable with respect to mounting portion 30' under the bias of an annular diaphragm 54'. Diaphragm 54' provides for biasing the rounded applicator tip 33' against the flange surface to provide externally controllable pressure on the flange surface as described above.

Furthermore, the end effector 20' is modified from the device shown above by providing a further arrangement for the accurate positioning and transporting of the ribbon of felt 14' with respect to the applicator tip 33'. In the embodiments shown in FIGS. 6 and 7, the felt is progressed through an entry member 40' which is a channel-like device supporting a plurality of rollers 41' at the lower end thereof. The felt 14' is passed from the tension device 16 (FIG. 1) through the entry device 40' where it is accurately aligned with respect to the lower end of central member 32' of end effector 20'. After the felt 14' has been pulled through the drive mechanism 45' it is positioned within an exit device 42 on the opposite of end effector 20'. Exit device 42 accommodates the used felt 14 through a pair of lower mounted rollers 43'.

The arrangement of the entry device 40' and exit device 42' of end effector 20' as well as the entry drum 40 and exit drum 42 of end effector 20 are shown by way of examples of techniques to accurately position and align the ribbon of felt with respect to the rounded application tip of the end effector. It may be appreciated, however, that other constructions and arrangements are within the contemplation of the present invention.

Various changes to the foregoing described and shown structures would now be evident to those skilled in the art.

What is claimed is:

1. An apparatus for preparing a surface onto which a gasket, bonding agent or the like is applied comprising:

a robotic device capable of movement along multiple axes;

an end effector supported by said robotic device for movement along said surface;

felt supply means located remotely from said robotic device for continuously delivering felt to said end effector under tension and retracting said felt from said end effector under tension; and a cleaning fluid delivery system for wiping a cleaning fluid directly onto said felt at said end effector.

2. An apparatus of claim 1 further includes a wiping device supported by said end effector for wiping said surface.

3. An apparatus of claim 2 wherein said wiping device is a squeegee.

4. An apparatus of claim 2 further including an air knife, supported by said end effector for force-flashing off said wiped fluid.

5. An apparatus of claim 4 wherein said wiping device is positioned on said end effector forward of said directional movement thereof and wherein said air knife is positioned on said end effector rearward of said directional movement thereof.

6. An apparatus of claim 1 wherein felt supply means includes a feed tensioning device for providing an extent of slack felt to said end effector.

7. An apparatus of claim 6 wherein said felt supply means includes a take-up tensioning device for retracting felt under tension.

8. An apparatus of claim 7 further includes a drive mechanism operable in combination with said feed tensioning device and take-up tensioning device to deliver and retract said felt.

9. An apparatus of claim 1 wherein said robotic device, said end effector, said felt supply means and said cleaning fluid delivery system are operable under the control of a numeric controller.

10. A robotically mounted end effector for preparing a surface onto which a gasket, bonding agent or the like is applied comprising:

an elongate end effector body having a distal application tip; and means for continuously advancing a felt ribbon along said application tip;

said end effector body having a central elongate cleaning fluid channel defining a dispense opening proximate of said distal application tip for dispensing cleaning fluid onto said felt ribbon.

11. An end effector of claim 10 wherein said dispenser opening is positioned to continuously apply fluid to said advancing felt ribbon.

12. An end effector of claim 11 wherein said application tip of said end effector is movable over said surface for wiping said fluid-containing felt ribbon over said surface.

13. An end effector of claim 12 including means for aligning said felt ribbon with respect to said application tip.

14. An end effector of claim 13 wherein said aligning means includes an entry drum for supporting said felt ribbon advancing towards said application tip, and an exit drum for supporting said fluid containing ribbon advancing from said application tip.

15. An end effector of claim 13 wherein said aligning means includes an entry member including a plurality of entry rollers for supporting said felt ribbon advancing towards said application tip and an exit member including a plurality of exit rollers for supporting said fluid- containing ribbon advancing from said application tip.

16. An end effector of claim 10 wherein said end effector body is moveable with respect to a mounting member so as to provide for biased engagement of said application tip against said surface.

17. An end effector of claim 16 wherein said effector body is spring biased against said surface.

18. An end effector of claim 17 is further including a diaphragm between said mounting member and said end effector body for providing said spring bias.

19. A robotically mounted end effector for preparing a contaminated surface onto which a gasket, bonding agent or the like is to be applied comprising:

an elongate end effector body having a distal tip for directional movement along said surface;

a fluid-wetted felt ribbon continuously advanceable across said distal tip to apply cleaning fluid to said surface;

a squeegee-like wiping device positioned on said end effector body forward of said directional movement of said end effector for wiping said contaminated surface; and an air knife position on said end effector for force-flashing off fluid applied by said felt ribbon.

* * * * *

UNITED STATES PATENT AND TRADEMARK OFFICE

CERTIFICATE OF CORRECTION

PATENT NO. : 6,292,976 B1
DATED : September 25, 2001
INVENTOR(S) : Kurcz et al.

It is certified that error appears in the above-identified patent and that said Letters Patent is hereby corrected as shown below:

Title page,
Item [74], the printed patent incorrectly reads "*Attorney, Agent or Firm* -- Hoffman & Baron, LLP". The application transmittal correctly reads -- Hoffmann & Baron, LLP. --.

Column 3,
Line 63, the printed patent incorrectly reads "...application, it may necessary for...", it should read -- ...application, it may be necessary for... --.

Signed and Sealed this

Twenty-first Day of May, 2002

*Attest:*

*Attesting Officer*

JAMES E. ROGAN
*Director of the United States Patent and Trademark Office*